US006857241B1

(12) United States Patent
Pellicer

(10) Patent No.: US 6,857,241 B1
(45) Date of Patent: Feb. 22, 2005

(54) BUILDING PANEL AND PLANT FOR THE MANUFACTURE THEREOF

(76) Inventor: Carlos Fradera Pellicer, Residencial "El Cortalet", Edificio A, Esc. E, 2o 3a, L'Aldosa, La Massana (ES)

( * ) Notice: Subject to any disclaimer, the term of this patent is extended or adjusted under 35 U.S.C. 154(b) by 0 days.

(21) Appl. No.: 10/030,679

(22) PCT Filed: Jul. 12, 2000

(86) PCT No.: PCT/ES00/00247

§ 371 (c)(1),
(2), (4) Date: Jan. 11, 2002

(87) PCT Pub. No.: WO01/04433

PCT Pub. Date: Jan. 18, 2001

(30) Foreign Application Priority Data

| | | |
|---|---|---|
| Jul. 13, 1999 | (ES) | 9901847 U |
| Feb. 17, 2000 | (ES) | 200000382 U |
| Mar. 2, 2000 | (ES) | 200000544 U |
| Mar. 2, 2000 | (ES) | 200000545 U |
| Mar. 8, 2000 | (ES) | 200000616 U |

(51) Int. Cl.[7] ..... E04B 2/00

(52) U.S. Cl. ..... 52/583.1; 52/293.1; 52/299; 405/267; 405/259.1

(58) Field of Search ..... 52/314, 235, 309.12, 52/309.7, 309.16, 309.17, 479, 484.1, 600, 601, 649.1; 264/297.9, 333

(56) References Cited

U.S. PATENT DOCUMENTS

| | | | | | |
|---|---|---|---|---|---|
| 1,031,926 | A | * | 7/1912 | Hansbrough | 52/259 |
| 1,597,373 | A | * | 8/1926 | Grimm | 264/245 |
| 1,682,253 | A | * | 8/1928 | Romero et al. | 52/601 |
| 2,169,255 | A | * | 8/1939 | Kotrbaty | 52/97 |
| 2,235,001 | A | * | 3/1941 | Allen | 264/69 |
| 2,703,003 | A | * | 3/1955 | Allen | 52/601 |
| 2,983,080 | A | * | 5/1961 | Whiteside | 52/385 |
| 3,245,185 | A | * | 4/1966 | Rowe | 52/315 |
| 3,867,800 | A | * | 2/1975 | Elliott | 52/347 |
| 4,112,646 | A | * | 9/1978 | Clelland | 52/372 |
| 4,472,919 | A | * | 9/1984 | Nourse | 52/601 |
| 4,642,960 | A | * | 2/1987 | Wallover, III | 52/390 |
| 5,003,743 | A | * | 4/1991 | Bifano et al. | 52/288.1 |
| 5,526,629 | A | * | 6/1996 | Cavaness | 52/745.19 |
| 5,715,637 | A | * | 2/1998 | Hesterman et al. | 52/315 |
| 6,170,213 | B1 | * | 1/2001 | Zarrelli et al. | 52/509 |
| 6,202,377 | B1 | * | 3/2001 | Krieger | 52/489.1 |
| 6,427,408 | B1 | * | 8/2002 | Krieger | 52/489.1 |

FOREIGN PATENT DOCUMENTS

| | | |
|---|---|---|
| CN | 606685 | 11/1978 |
| FR | 2253358 | 6/1975 |
| GB | 1059832 | 2/1967 |

OTHER PUBLICATIONS

Copy of International Search Report for PCT/ES00/00247 completed Oct. 16, 2000.

* cited by examiner

*Primary Examiner*—Carl D. Friedman
*Assistant Examiner*—Nahid Amiri
(74) *Attorney, Agent, or Firm*—Alston & Bird LLP

(57) ABSTRACT

This building panel consists of lightweight panel for external or internal closures of latticework support structures, which is constituted by slabs of air-setting resistant material. The slabs are reinforced in the facade panels for external closures and unreinforced for the dividing panels for internal closures. They are provided with a patterned surface on the visible face and are smooth or shaped at the edges. The visible face is formed by a thin layer of molded synthetic resin or fine mortar paste. When the layer is molded synthetic resin and is disposed as a shell for the panel, it comprises over the whole of the inner surface thereof an internal synthetic resin layer, the entire free surface of which is covered with a solid bulk material, the components of which firmly partially anchored in said internal layer and afford a substantial free surface for anchorage of the air-setting material forming the resistant body poured thereover. This material fills the entire volume of said panel shell, at the same time as it includes therein reinforcement means provided with points directly accessible from the outside of the concealed face of the panel.

13 Claims, 11 Drawing Sheets

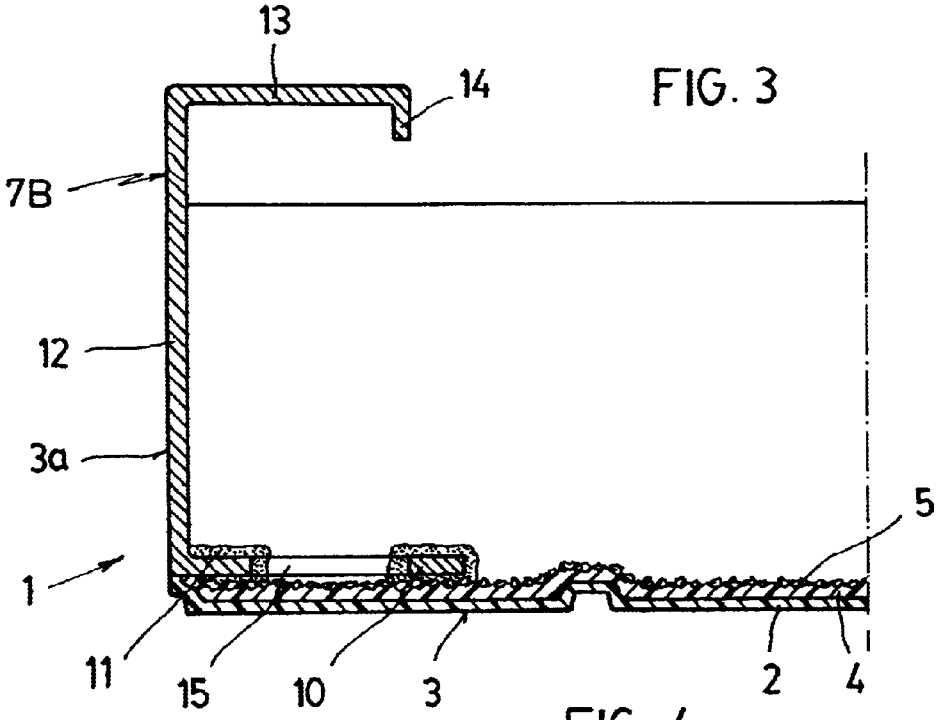
FIG. 3
FIG. 4
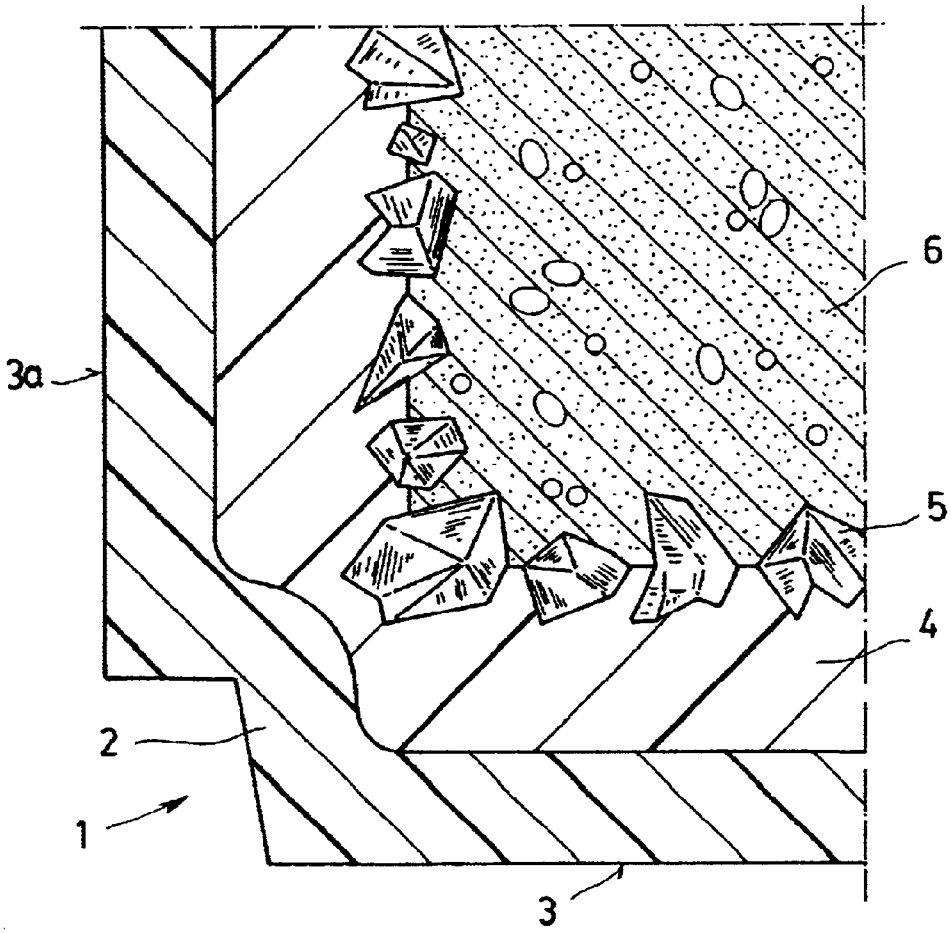

BUILDING PANEL AND PLANT FOR THE MANUFACTURE THEREOF

FIELD OF THE INVENTION

This invention relates to a building panel and to a plant for the manufacture thereof. To be precise, it relates to a lightweight panel for external or internal closures of latticework support structures, formed by uprights connected by horizontal crossmembers. The panel is formed by slabs of air-setting resistant material which are reinforced in the facade panels for external closures and unreinforced in the dividing panels for internal closures and which have a patterned surface on the visible face thereof and a smooth or shaped surface at the edges thereof. The surface is formed by a thin layer of a synthetic resin or a fine mortar paste. The layer is formed as a shell partially enveloping a body of air-setting resistant material on which it confers a quality finish of architectural type with essential properties of resistance to weathering and environmental pollution and is formed in molding arrangements constituted by a mold-holder having an engraved bottom wall, on which there is seated the mold forming the pattern of the visible face, the mold being made of polyurethane, silicone, etc and being surrounded by side members shaping the edges of the slabs. This shell, after solidification, forms the mold for the said air-setting resistant material.

Prior Art Reference

Building panels meeting the specifications contained in the foregoing generic description are known from Spanish Utility Model 9900014 of the present applicant. In said document there is contemplated the formation of the surface of the visible face and the edges of the panel by molding at least three layers of synthetic resin.

Such building panels have drawbacks such as, in principle, the difficulty of forming an intimate bond between the synthetic resin layer, forming the visible surfaces of the panel and the resistant body material, particularly when this material consists of an air-setting hydraulic material, such as a cement or lime mortar, concrete, plaster and the like.

To overcome this problem of bonding the two materials together, the solution was adopted of inserting between them a layer having affinity to both, such as a layer of a hydrolysable resin. While the foregoing solution is generally sufficient for its task, it is delicate to carry out since it depends on many factors which are hard to control in industrial production to the extent that, under extreme environmental conditions, the patterned layer may separate from the resistant material body.

Also, a further drawback detected in the panels disclosed in the aforementioned Spanish Utility Model 9900014 is that the means provided for attaching the panel to a support structure are internal to the panel and are complex, artificious and hard to use, providing for unreliable attachment, which is quite unacceptable in a building, where these support structures are of lattice type formed essentially by metal upright sections which are connected by horizontal metal cross-member sections, with the ensemble being stabilized by strutting.

According to the regular practice, the facade panels are attached to the support structure by way of stirrups which are anchored in the mass of the structure, by a tongue-and-grooved arrangement or engagement in notches in the openings of the structure and fixation thereof by masses of cement, by screwing, by welding of stirrups, frames or couplings to metal sections of the structure, etc. All these systems suffer from the drawback that they are complex, require scaffolding and shuttering in the majority of cases, require specialized labor and are not absolutely reliable in situations of movement of the structure due to settling thereof, to the action of gale force winds, earthquakes, explosions, etc.

Furthermore, when prefabricated panels reproducing architectural type patterns on the visible face thereof, such as stone masonry, brickwork, carvings or other designs, are set side-by-side, the joints formed longitudinally and transversally therein are extremely obvious, breaking the aesthetics of the pattern design.

Thus, in facade panels imitating brickwork, where the bricks are arranged in break joint courses, it is obvious that a panel of this type will have at the vertical edges thereof bricks of one course whose edges coincide with the edge of the panel and bricks in adjacent courses which are split in half. This arrangement reveals the imitation, which is unaesthetic and impossible to hide with putties and the like. This is a limitation for the use of such facade panels imitating brickwork.

The same happens with facade panels imitating natural stone masonry, in which case it is much more difficult to disguise the straight lines of the joints, since the joints between the stones are very irregular and in no case are they straight.

In other cases, which are very frequent in the new building trade techniques, it is normal to install internal plasterboard, fiberboard, etc slabs which are used in heterogeneous wall structures to accompany a prefabricated facade panel and form a thermal and acoustical insulation space in cooperation with another similar slab, in this case made from plasterboard which, acting as internal closure of the wall, forms the visible face thereof inside the room so formed. Thus, in the building trade, it is a regular practice, particularly in the case of buildings formed by a lattice support structure formed by wooden beams or light metal sections, to attach the facade closure panels to the lattice support structure with screws, with the insertion of one of said internal plasterboard, fiberboard panels, etc.

This assembly system has the drawback that the movements due to settling of the structure, to the effects of wind, to snow loads, to seismic movements, structural vibrations, explosions or others cause relative movements between the members of the lattice structure and the facade panels, causing deterioration of said internal slabs by the sawing action caused therein by the ensemble attachment screws, which changes the distance between the lattice structure and the facade panels. As a result, the drawback arises that such panels are placed in a swaying situation, leading not only to an aesthetic deterioration, but also to the risk of separation and, furthermore, the structure loses the strutting effect offered by said internal slabs.

Lightweight facade panels made substantially by individual molding of a mass of cement mortar with the inclusion of a metallic reinforcement, such as the embodiments disclosed in Spanish patent 9900369 and utility models 9900014 and 9901847, of the present applicant, are known. These are manufactured in known plants in which to prepare the prefabricated items of mortar or concrete, long heated tracks are used on which the molds are placed. Firstly, the reinforcement members are placed in them and, thereafter, the mortar or concrete is poured and vibrated. After this, the molds are allowed to rest, until a sufficient degree of setting has been attained to be able to strip the molds and stack the pieces obtained until setting is complete.

These plants require large spaces to lay out the tracks, a high energy consumption to heat the tracks, moving means for placing and installing the reinforcement and other, also moving, means for pouring and vibrating the concrete, all of which means that such plants are extremely burdensome and hardly competitive, to which there should be added the enormous number of molds required for a profitable manufacturing operation.

SUMMARY OF THE INVENTION

In view of the foregoing, it would be desirable to have a building panel fulfilling the largest number of the following conditions:

1. have unbeatable conditions of adhesion of the patterned layer to the material of the resistant body.
2. be provided with reinforcement means which allow it to be attached to a lattice support structure, are easy to produce, may be accurately located and are completely reliable under extreme conditions.
3. coordinate the attachment thereof to the lattice support structure with the attachment of inside wall internal slabs.
4. comprise a buttstrap arrangement hiding the joints between panels having an architectural pattern.
5. be simple and speedy to manufacture with high quality in a plant which is economical in equipment and labor.

The building panel of the invention has been developed in accordance with the foregoing solution. Nevertheless, it may have other applications in decoration, industrial and civil protection, etc. In the panel, the molded synthetic resin layer, disposed as a shell therein, is provided over the whole of the inner surface thereof with an internal layer, also of synthetic resin, having the whole of the free surface thereof covered with a solid bulk material, the components of which, having a part thereof firmly anchored to said internal layer, provide a substantial free surface for the anchorage of the resistant material of the body applied thereover, which material fills the entire volume of said panel shell, at the same time as it incorporates therein reinforcement means provided with points directly accessible from the outside of the concealed face of the panel.

According to the invention, the solid bulk material is preferably constituted by an aggregate having a large specific surface area and, more precisely, by a sand formed by sharp-edged angular, preferably non-eroded grains. Also comprised within the idea of solid bulk material are metal shavings, metal fiber reinforcements, grit, etc.

According to the invention, the points of the internal reinforcement means accessible from the outside are located in such a way as to extend clearly from the surface of the concealed face of the panel. In any case, the points of the reinforcement means accessible from the outside are formed by parts of said reinforcement means emerging from the resistant body of the panel on the concealed face thereof. Thus, in a particular case, the reinforcement means comprise flanged top-hat-shaped means having a portion of the U-shaped part thereof projecting from the outside level of the hydraulic material on the concealed face of the panel, and the brim portions thereof are applied against the surface of the solid bulk material.

The invention also contemplates that the reinforcement means comprise metal sections forming the visible portion of the panel edges. One preferred embodiment contemplates that the section constituting the edges of the panel is an angle section and the web thereof is wider than the thickness the edges and is folded orthogonally and in parallel with the surface of the concealed face of the panel to form an anchorage tab which may have a stiffening flange directed towards the surface of said concealed face of the panel.

In all cases, it is deemed desirable that the metal sections are provided with apertures in the webs and/or seating wings thereof allowing the mass of resistant material of the body to pass therethrough, so as intimately to embrace a part of the metal section structure.

It is a further feature of the invention that some metal sections are situated lengthwise and others crosswise relative to the panel, forming a frame arrangement. In one case, the metal sections forming the frame arrangement may be accompanied by other metal sections disposed parallel to one and/or the other of the longer and shorter sides of said frame arrangement and, in all cases, the metal sections comprise corrugated rods transversely crossing said frame and metal section arrangements, said rods being fixedly attached to points thereof, and also optionally accompanied by open mesh wire netting, meshes, etc.

According to the invention, the material forming the body resistant to mechanical stresses of the construction is one of the group formed by: cement concrete, cement mortar, resin mortar, mixed hydraulic and resin mortar, plaster, lime mortar and synthetic resins, either normal or lightened, alone or in combinations thereof.

According to the invention, the resistant body of the panel may be formed by an inner layer of a heavy, air-setting resistant material, for the anchorage of the patterned layer and of part of the metal reinforcement sections, and an outer layer of a lightweight resistant material, completing the body, conferring a greater thermal and acoustical insulating power thereon and forming the concealed surface of the panel. Also according to the invention, the outer layer of the lightweight resistant material may be preformed as a prefabricated slab.

According to the invention, the synthetic resin of the layer molded as a shell consists of a gel-coat of a resin of the group formed by polyesters, polyurethanes, phenolic resins and epoxy resins, either alone or in combination, incorporating, in all cases, a base coloring agent and, optionally, ornamental and/or distinguishing surface coloring arrangements.

One aspect of the invention has a special application, in the building trade, in the above mentioned case of the assembly of the internal plasterboard slabs, fiberboard slabs, etc., where, according to the invention, the internal slab is applied directly, independently of the facade panel, to the support structure, in such a way that it occupies one or more cells thereof and is flanked, in any case, by the corresponding upright and transverse sections, to which it is directly solely attached by screws or other means, at the wings thereof, or to another portion, at end points of the support structure lattice, occupying one or more of the cells thereof, in such a way as to replace the conventional herring-bone strutting.

To avoid the problems appearing in panels having a surface decorated with architectural relief (brickwork, masonry, etc), with a view to disguising the joints between panels, according to the invention the edges of the sides of the panel to be placed juxtaposed to the sides of other panels are provided, at the places on the visible face thereof where the joints cut across the relief of the pattern design, with slightly depressed areas, with those of an adjacent edge of one panel mating with those on the edge of the other panel. Once the panels are installed, these areas define depressed facade areas affecting part or the whole of the joint and in which inserts bearing the design are fitted to form the continuation of the pattern design on the visible faces of the juxtaposed panels.

With a view to manufacturing the panel of the invention under the best conditions, a plant has been devised comprising a track for the movement of carrier devices for the molds forming the facade panel on which there are situated sequentially according to the operative stages required for the manufacture of the facade panel a number of work stations which, defined by the means and/or members pertaining to the work stage proper thereto are listed in order below:

(a) means for cleaning the molds and/or mold carriers, appropriate for removing any mortar and mold stripper remains deposited thereon, (b) means for changing the molds, to be used only when the panel to be manufactured has different features from those of the panel which has been stripped from the mold, which means are complemented by shelving for use as a mold store, (c) means for applying a mold stripping product over the entire molding surface, (d) means for spraying over the entire molding surface a thin layer of a first resin (gel-coat) which waterproofs and enhances the pattern of the visible face of the panel, (e) a tunnel with shelving for storing the molds in the carriers thereof, in stand-by for the curing of the resin sprayed in the molds and/or for the following operation on the mold, (f) means for spraying a thin layer of a second anchor resin on the first resin layer, (g) means for spraying a layer of coarse grained material (such as sand, shot, etc.) on the second resin layer, so as partly to incrust said coarse grains in the resin and for removing the grains not adhering thereto;

(h) a tunnel with shelving for storage of the carriers bearing the molds charged with both resins and the coarse grains incrusted in the second resin, in stand-by for the curing of the second resin and/or the following operation, (i) means for pouring cement mortar on the second resin and the coarse grains, which is prepared from the cement, aggregate, water and additives drawn from silos adjacent the station, (j) means for placing the reinforcement in the cement mortar and, optionally, a suspension cable for the panel anchored in said reinforcement, (k) a tunnel kiln with shelving for the setting of the cement mortar, and (l) mold stripping means and shelving for stacking the finished panels.

A further feature of the invention resides in the fact that when the architectural features and the resins of the facade panels and, therefore, the polyurethane molds are not used, the molding surface is formed by the bottom wall of the mold carrier devices devoid of said molds, whereby the sequence of operative work stations is reduced to the following:

means for cleaning (a) the mold-free mold carrying devices, appropriate for removing any mortar and mold stripper remains, means for applying (c) a mold stripping product over the entire molding surface, a tunnel with shelving (h) for storing the mold carrier devices, in stand-by for the following operation, means for pouring (i) cement mortar on the molding surface formed by the mold carrier devices, which is prepared from the cement, aggregate, water and additives drawn from silos adjacent the station, means for placing (j) the reinforcement in the cement mortar and, optionally, a suspension cable for the panel anchored in said reinforcement, a tunnel kiln (k) with shelving for the setting of the cement mortar, and mold stripping means (l) and shelving for stacking the finished panels.

BRIEF DESCRIPTION OF THE DRAWING

Further features of the invention will be disclosed in the following description, with reference to the accompanying drawings, in which:

FIG. 3 is a view of a shell portion similar to the one shown in FIG. 1, in which the part forming the panel edge is constituted by part of a reinforcement means.

FIG. 4 is a detail of the cross section view of FIG. 2, in which there has been incorporated the mass of material constituting the resistant body and showing how the patterned layer shell and the resistant body are anchored together.

DETAILED DESCRIPTION OF THE INVENTION

Figure 1:
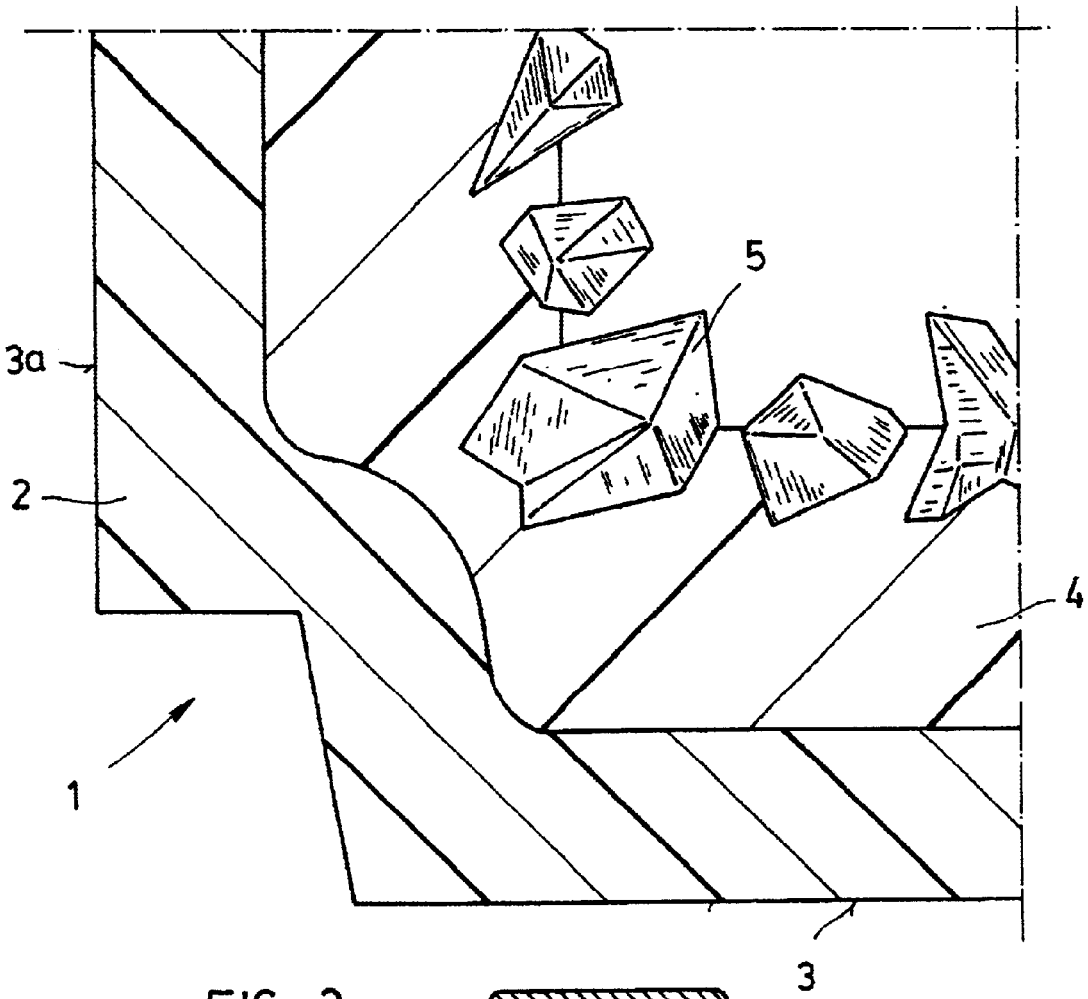
FIG. 1 is a cross section view of a corner portion of a panel, corresponding to the outer patterned layer which, in shell-like fashion, shows one provided with its inner resin layer and a solid bulk material partly incrusted in said inner layer.
Figure 2:
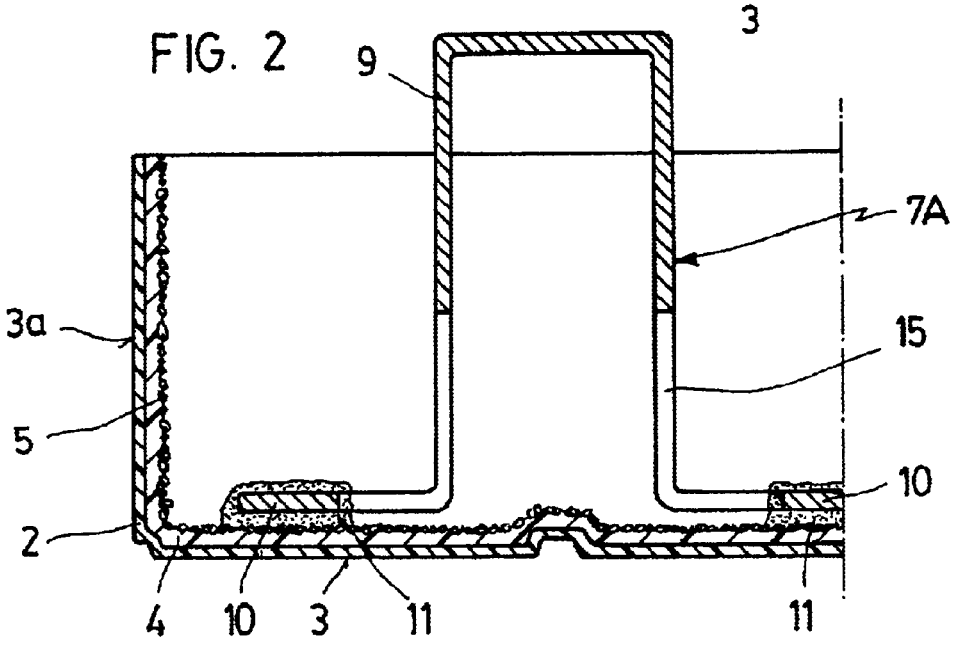
FIG. 2 is a view of the shell portion according to FIG. 1 to which a reinforcement means of the type formed by top-hat-shaped metal sections,as been added.

FIG. 1 shows a building panel 1 having, according to the invention, a structure constituted by a patterned layer 2 which, molded in synthetic resin, forms the patterned surface of the visible face 3 of the panel and constitutes a sort of shell for the panel 1 which comprises the edges 3*a*.

The said external layer 2 comprises, over the entire inner surface thereof, an inner layer 4, also of synthetic resin, having the entire free surface thereof covered with a solid bulk material 5. The components of this material are firmly embedded in part in said inner layer 4 and provide a substantial free surface area for anchoring the material of the resistant body 6 applied thereover, which material fills the entire volume of the said panel shell 1, at the same time as it includes therein reinforcement means 7, in general, which are provided with points directly accessible from the outside of the concealed face 8 of the panel 1, as may be seen in FIGS. 2, 3, 5, 6 and 9.

The solid bulk material 5 will preferably be constituted by an aggregate having a large specific area, such as a sand having sharp-edged angular grains, optionally uneroded, without dismissing, notwithstanding, other materials which may be suitable, such as grits, metal reinforcement fibers, metal shavings, etc.

Figure 5:
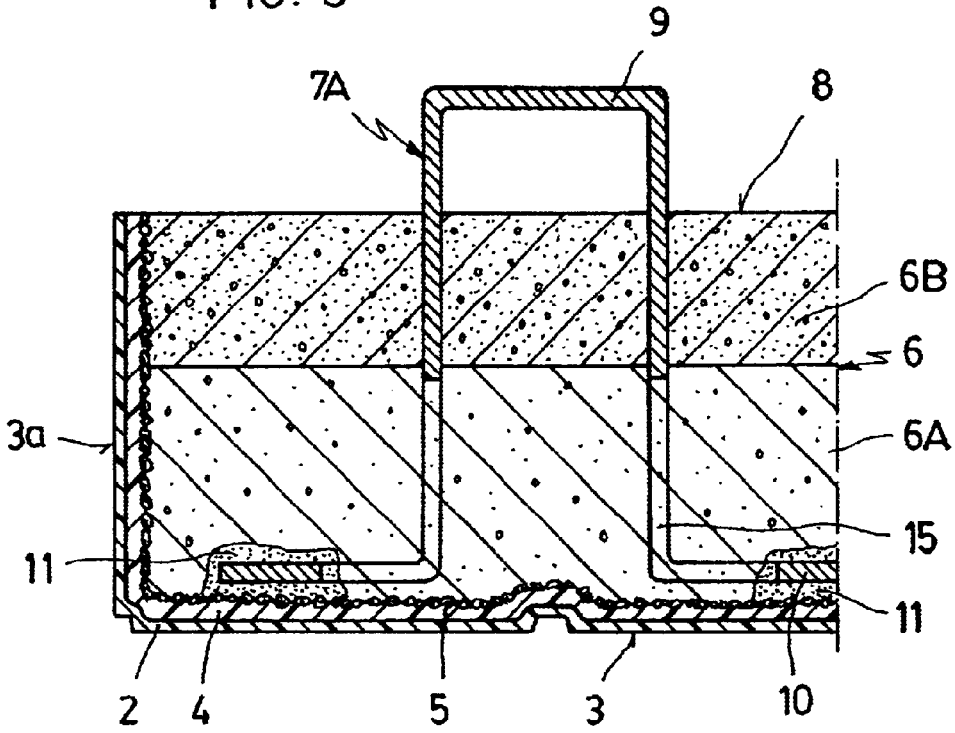
FIG. 5 is a cross section view of an end portion of a panel provided with the reinforcement means of FIG. 2.
Figure 6:
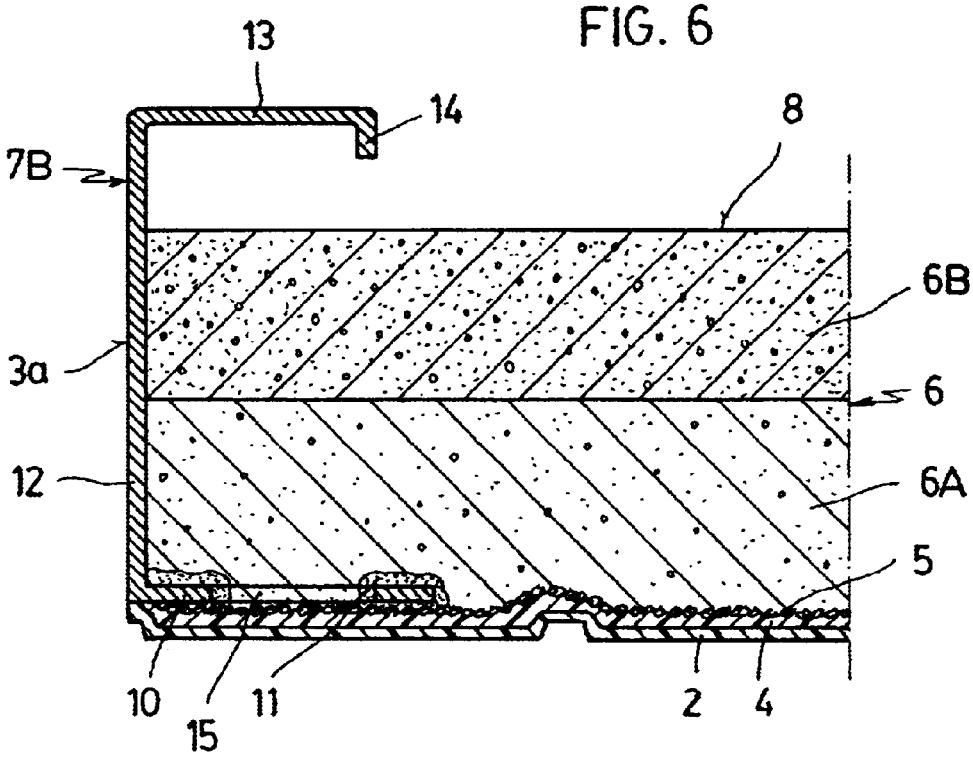
FIG. 6 is a cross section view of an end portion of a panel provided with the reinforcement means of FIG. 3.
Figure 9:
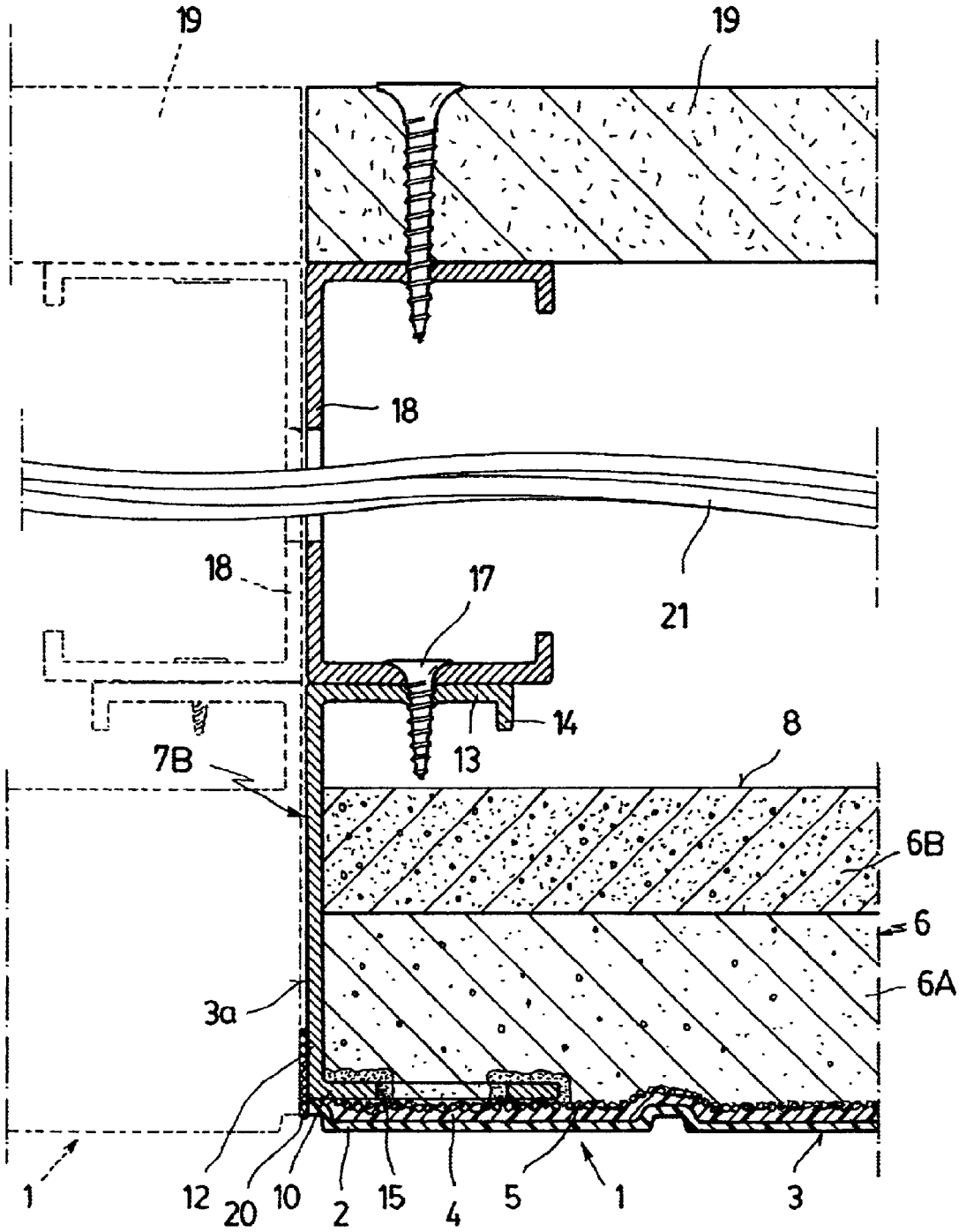
FIG. 9 shows a wall arrangement in which there is included a panel according to FIGS. 3 and 6, as an external closure member, and a conventional plaster board panel as internal closure.

The points of the reinforcement means 7 accessible from the outside are constituted by parts of said means, or members fixedly attached thereto, projecting out from the resistant body 6 on the concealed face 8 thereof, as may be seen in FIGS. 5, 6 and 9, forming an external surface to which screws may be applied.

The reinforcement means 7 may be of different shapes, according to the secondary function required of them. Thus, said means may consist of top-hat-shaped metal sections 7A or metal angle sections 7B, the latter being those which at the same time constitute the edges 3*a* of the panel 1, as may be seen in FIGS. 2 and 5 and in FIGS. 3, 6, 7, 8 and 9, respectively.

Where the top-hat-shaped metal sections 7A are used, they have a part 9 of the "U" portion projecting out from the surface of the concealed face 8 at the same time as the brim portions 10 thereof are applied to the anchorage surface formed by the solid bulk material 5 and optionally attached thereto, by means of a filler material, such as a resin 11.

Where the metal angle sections 7B are used, the web 12 thereof forms the edge 3*a* of the panel 1 and is wider than the thickness of the panel 1 and is folded orthogonally over a short distance parallel to the surface of the concealed face 8 of the panel 1 to form an anchoring wing 13 for use with screws. The tab 13 may be provided with a stiffening flange 14 directed towards the said concealed face 8. This section also forms a seating wing 10.

In all the cases described, the metal reinforcement sections 7 are provided with apertures 15 in the webs and/or seating wings 10 thereof, which allow for the passage of the mass forming the resistant body 6, so as intimately to embrace part of the body of the metal sections 7.

The said metal sections 7 will preferably be located longitudinally relative to the panel 1. Nevertheless, some of said metal sections 7 may also be located crosswise, in which case a perimetral reinforcement frame will be formed, as may be seen in FIG. 7.

Figure 7:
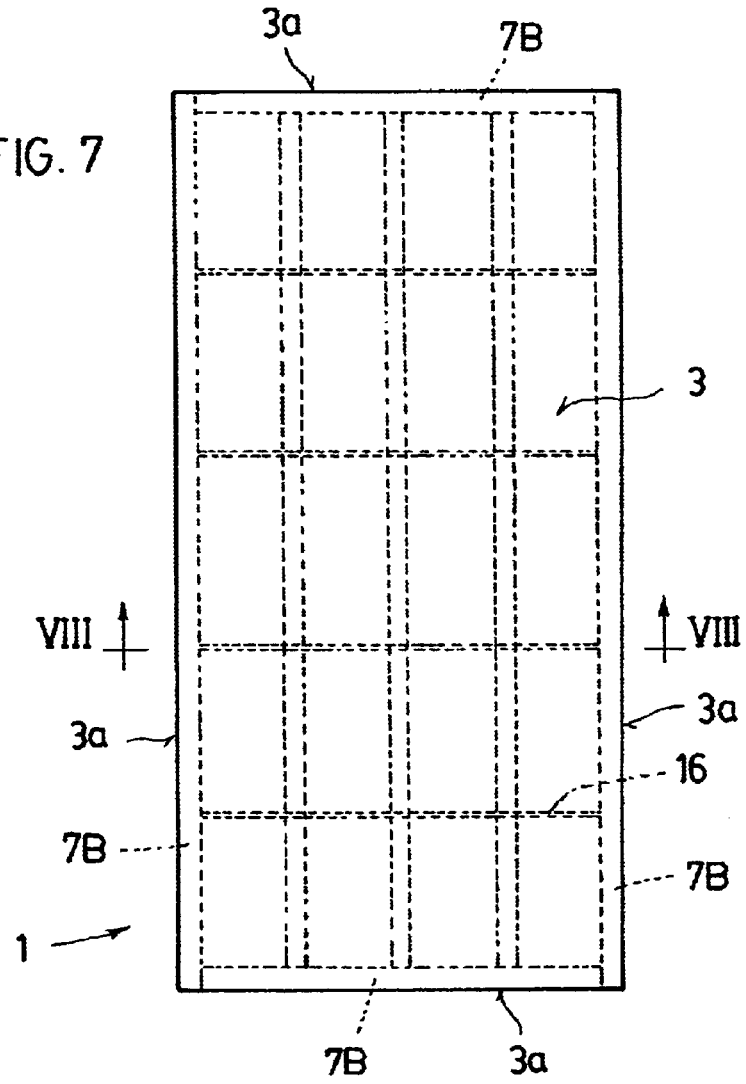
FIG. 7 is a plan view of a building panel showing an arrangement of the reinforcement means in which the latter form an edge frame.

Furthermore, the metal sections 7 forming the frame arrangement shown in FIG. 7 may be accompanied by further similar metal sections which may be arranged parallel to one and/or the other of the sides of said frame arrangement.

Figure 8:
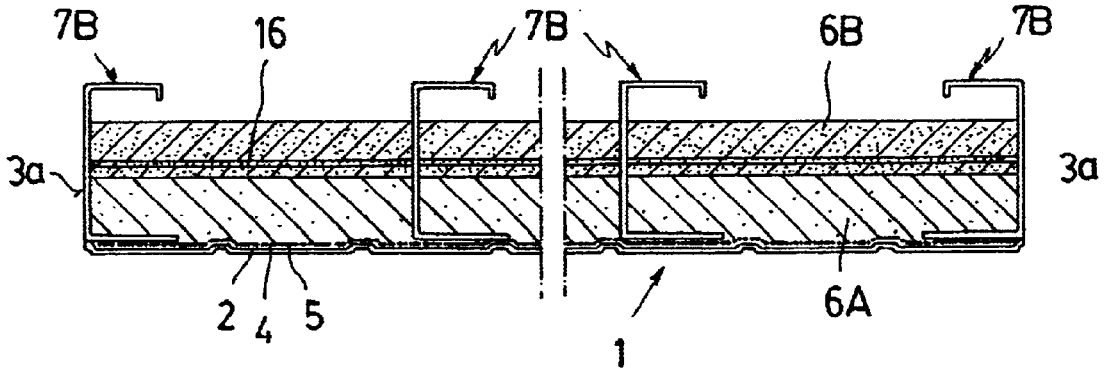
FIG. 8 is a cross section view on the line VIII—VIII of FIG. 7.

Furthermore, as shown in FIG. 8, the frame and metal section arrangements parallel to one or the other of the sides of the frame comprise corrugated rods 16 which are attached at the ends thereof to said frame arrangements and pass through the intermediate metal reinforcement sections, to which they are attached by welding or other means. These corrugated robs 16 may be accompanied, or replaced, by open metal fabrics, lightweight meshes, etc.

The resistant body 6 is formed by a material of the group comprising: cement concrete, cement mortar, resin mortar, mixed mortar and synthetic resins, either normal or lightened, alone or in combinations thereof or with other suitable materials, without excluding, therefore, other binding materials, such as lime mortar, plaster, etc.

Said resistant body 6 may be formed by a single layer, or an inner layer 6A of a heavy, air-setting resistant material, for the anchorage of the patterned layer and of part of the metal reinforcement sections 7, and an outer layer 6B of a lightweight resistant material, completing the thickness of the resistant body 6, conferring a greater thermal and acoustical insulating power thereon and forming the concealed surface 8 of the panel 1. This outer layer 6B may be preformed as a prefabricated slab of man-made or synthetic lightweight material or by a mixture of both.

The synthetic resin comprising the patterned layer 2 and of the inner layer 4, and forming the shell of the panel 1, consists of a gel-coat of a resin preferably of the group formed by polyesters, polyurethanes, phenolic and epoxy resins, either alone or in combination, incorporating, in all cases, a base coloring agent and, optionally, ornamental and/or distinctive surface coloring arrangements.

FIG. 9 illustrates a fragmentary cross section view of one side of an external closure panel 1. It is attached by means of a self-boring self-tapping screw 17 through the anchor wing 13 of the metal angle section 7B to a section 18 of a support structure. The said panel 1 is completed with an inner closure panel 19, of the plasterboard type, with the ensemble forming a wall for a building. Seals 20, which may be made from an elastomer, silicone, etc are provided between the juxtaposed edges of two adjacent panels 1. Raceways, insulation materials, etc., may conventionally be located between the panel 1 and the panel 19.

Figure 10:
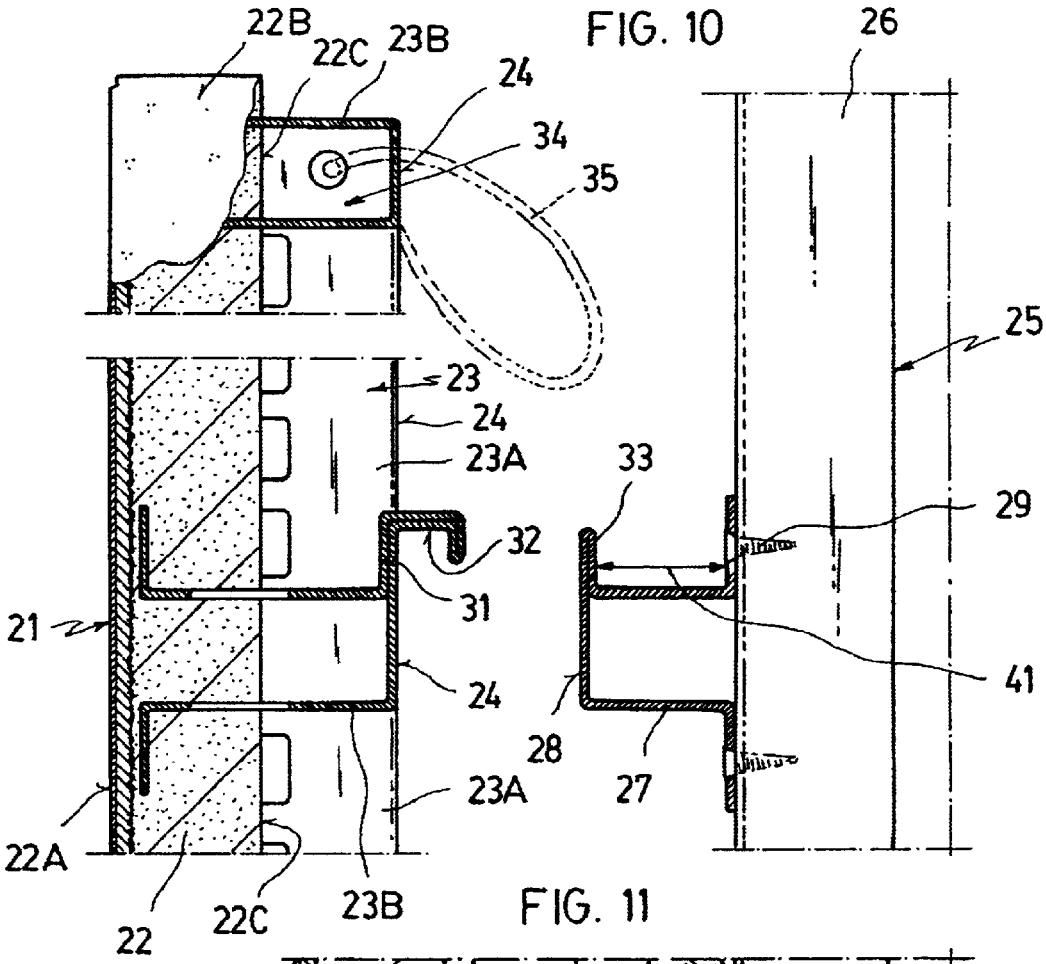
FIG. 10 is a side elevation view, partly in section, of an upper end portion of a facade panel confronting a node of the latticework structure constituted by a cross-member section attached to an upright section, the facade panel portion and one longitudinal half of the upright section having been illustrated in cross section.

The facade panel 21 shown in FIG. 10 is constituted by a resistant cement mortar body. Formed as a slab 22, the visible face 22A and the edges 22B thereof may be formed by another material, such as a synthetic resin, or another quality of the same material, such as a fine cement mortar paste. The visible face 22A may likewise have a smooth texture or a decorated texture with ornamental relief work imitating stone masonry, brickwork, wood, marble, etc, with or without color arrangements. The surface of the concealed face 22C will normally be a simple smoothed mortar mass.

Figure 11:
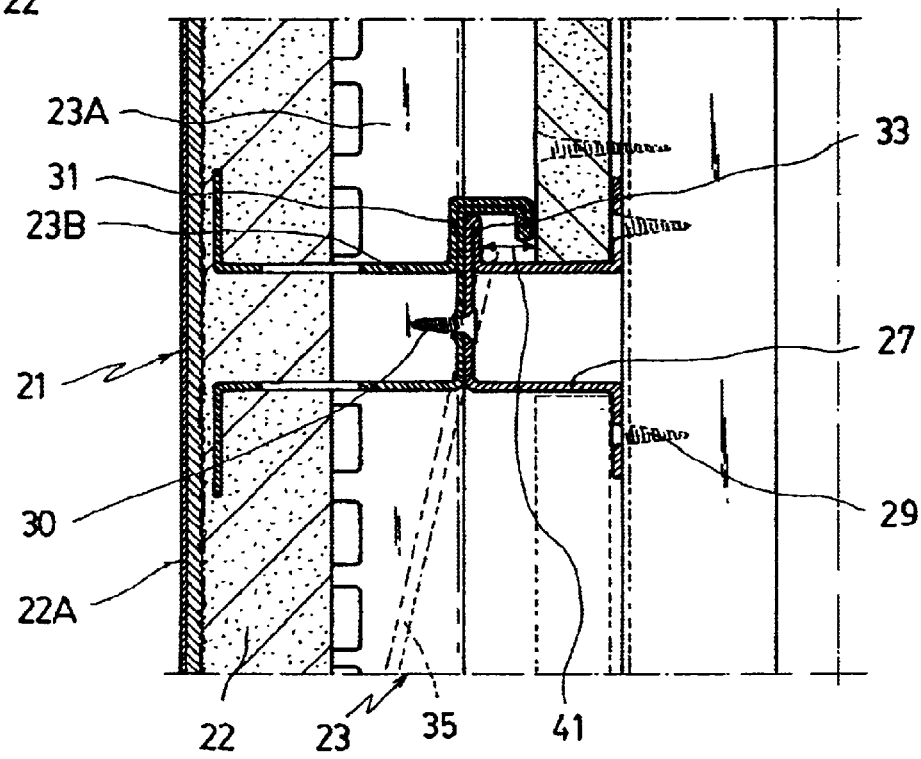
FIG. 11 is a view of the elements shown in FIG. 10, in a position of mutual attachment at the node, there having been inserted between them, independently of the node, an internal insulation slab, supported only by the latticework structure.
Figure 12:
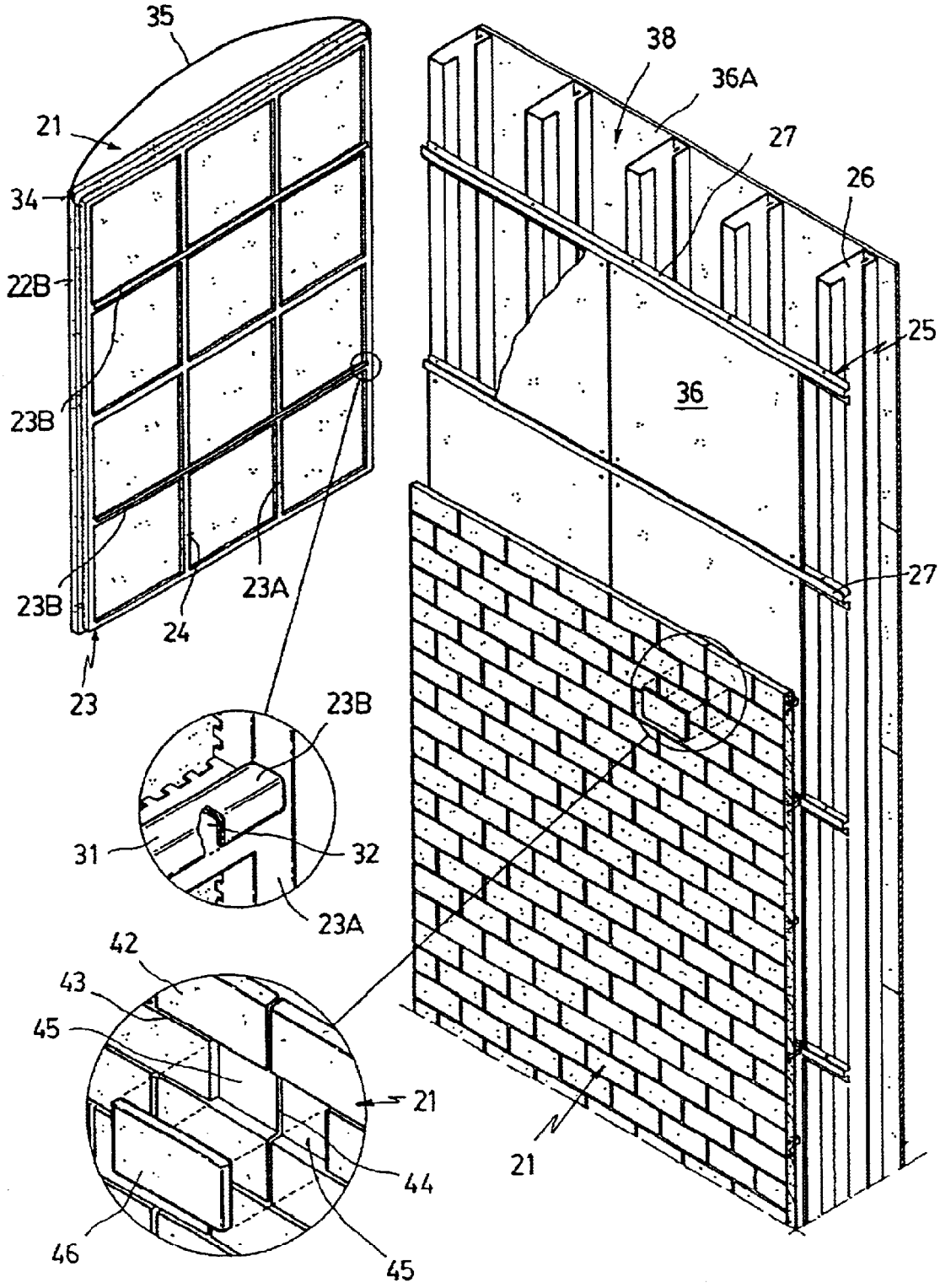
FIG. 12 is a perspective view of a facade panel at an angle in one possible stage prior to its final assembly positioning in a portion of latticework structure, accompanied by illustrative details.

The facade panel 21 is, furthermore, provided with a reinforcement constituted essentially by top-hat-shaped reinforcement sections 23 or the like, arranged in such a way that a spine 24, as shown in FIGS. 10 and 11, or a tab, such as the one as shown in FIGS. 6, 8 and 9, each parallel to the concealed face 22C, always projects out from said concealed face 22C of the slab 22 of the facade panel, and structured in frame-like form with internal stringers 23A and cross members 23B, as shown in FIG. 12.

The lattice support structure 25 is constituted by upright sections 26, preferably having a right-angled "C" cross section, of which the longitudinal half has been illustrated in the majority of the Figures. They are connected together by top-hat-shaped cross member sections 27 having a spine 28 and are attached to the upright sections 26 by screws 29, rivets, welding or other means, forming rigid nodes at the intersections.

Figure 13:
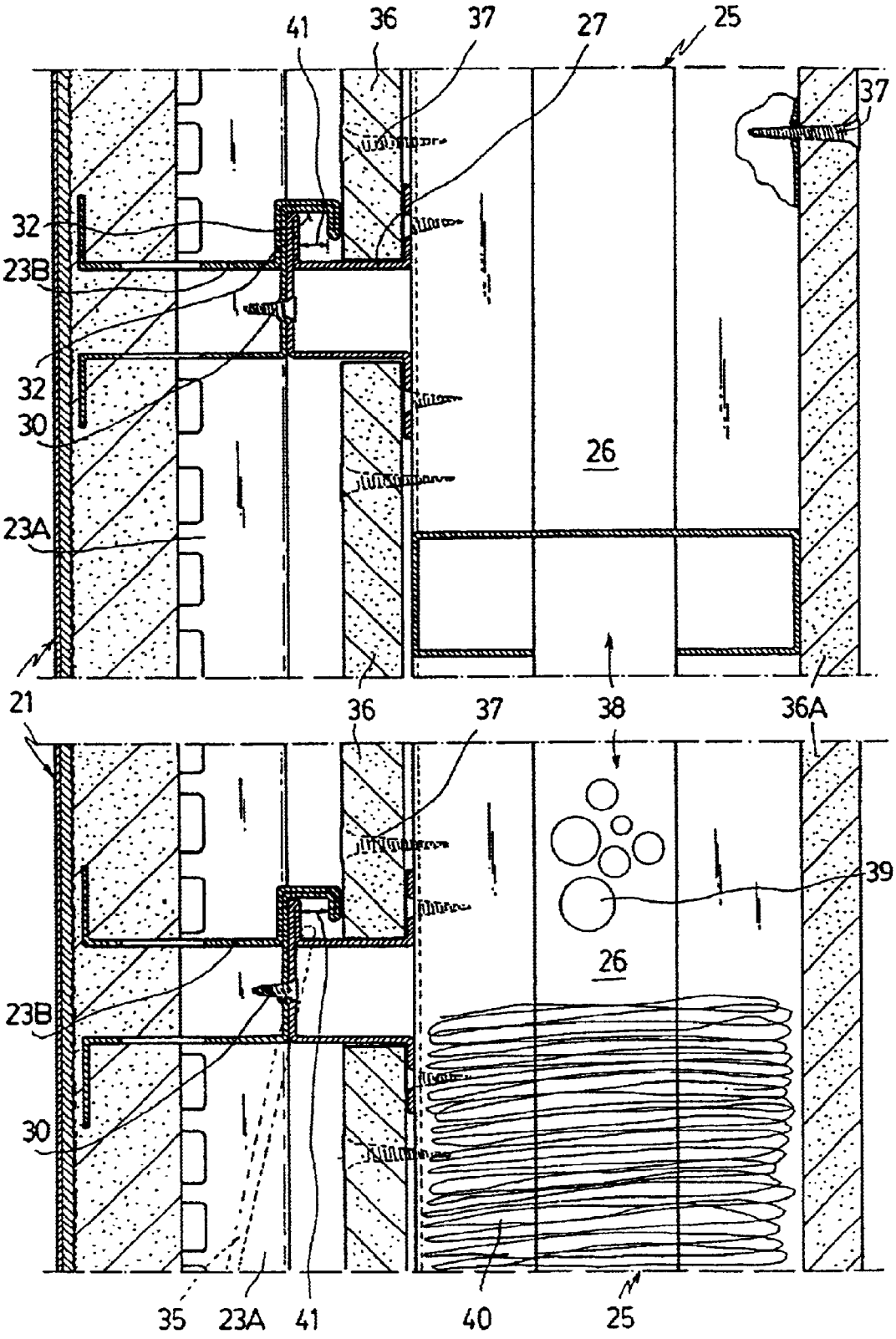
FIG. 13 is a vertical cross section view of a building wall in which the device of FIGS. 10 and 11 has been used to effect the assembly of the facade panel to the latticework structure.

According to the invention, it is contemplated that some of the cross members of the reinforcement sections 23B of the facade panels may have the spines 24 confronting and touching the spines 28 of the cross member sections 27 of the lattice structure 25 in the final assembly position thereof, as shown in FIGS. 11 and 13, thereby allowing them to be attached together with screws 30, rivets or other mechanical fixation means.

Also, as shown in FIG. 10, forming the main feature of the invention, it is contemplated that the spine 24 of the reinforcement sections 23B of the facade panels 21 be extended with an outstanding wing 31 parallel to the concealed face 22C of the slab 22 which, folded over 180°, forms a broad channel 32 which opens downwardly in the final assembly position.

Complementarily to the foregoing, the invention contemplates that the spine 28 of the cross member sections 27 of the lattice structure 25 extend outwardly forming a flange 33 which is directed in the opposite direction to the said broad channel 32 and is housed with a clearance therein in the final assembly position, as shown in FIG. 11.

The facade panels 21 may be provided with a safety arrangement against accidental release, consisting of one of the reinforcement sections 23 of the top side of the frame housing longitudinally in the tubular conduit 34 formed by the inner arch of the spine 24 with the concealed face 22C of the slab 22, a loose, resilient, resistant filiform member 35, such as a steel cable, a chain, etc., of closed contour, which may be firmly anchored to the lattice structure 25. Also, any other arrangement of the filiform member 35, which were not closed, would be adequate.

A facade wall made according to the invention is shown in FIG. 13. It is to be seen here that the facade panel 21 is provided with two reinforcement sections 23A capable of engaging the corresponding flanges 33 of the cross member sections 27 of the lattice structure 25 by way of the channels 32 thereof. The upright sections 26 of the lattice structure have been drawn completely, with schematic graphic indication of the right-angled C-shaped section thereof.

FIG. 13 also shows the arrangement of the internal slabs 36 of compound material, such as plasterboard, fiberboard, etc., which are in any case attached directly by screws 37 to the upright sections 26 and/or to the cross member sections 27, forming an insulating air space 38 housing the electricity, gas, water, telephone, etc. lines 39 and comprising a thermally and acoustically insulating fibrous material 40. The internal slabs 36A, as detailed in FIG. 13, constitute the interior surface of the room.

As will be understood, the invention also contemplates the reverse case to the one shown, in which the reinforcement sections 23B are provided with a downwardly directed flange and the cross members 27 are provided with an upwardly open channel 32, in which said flange may engage.

The clearance 41 provided between the channel 32 and the flange 33 allows the flatness and vertical and horizontal alignment of one facade panel 21 to be adjusted relative to the adjacent facade panels.

The resilient filiform element 35, apart from its mission of assuring the facade panels 1 against accidental falling, may be used as suspension means for the facade panels 21 in the stages of assembly to the lattice structure 25 and handling thereof.

Figure 14:
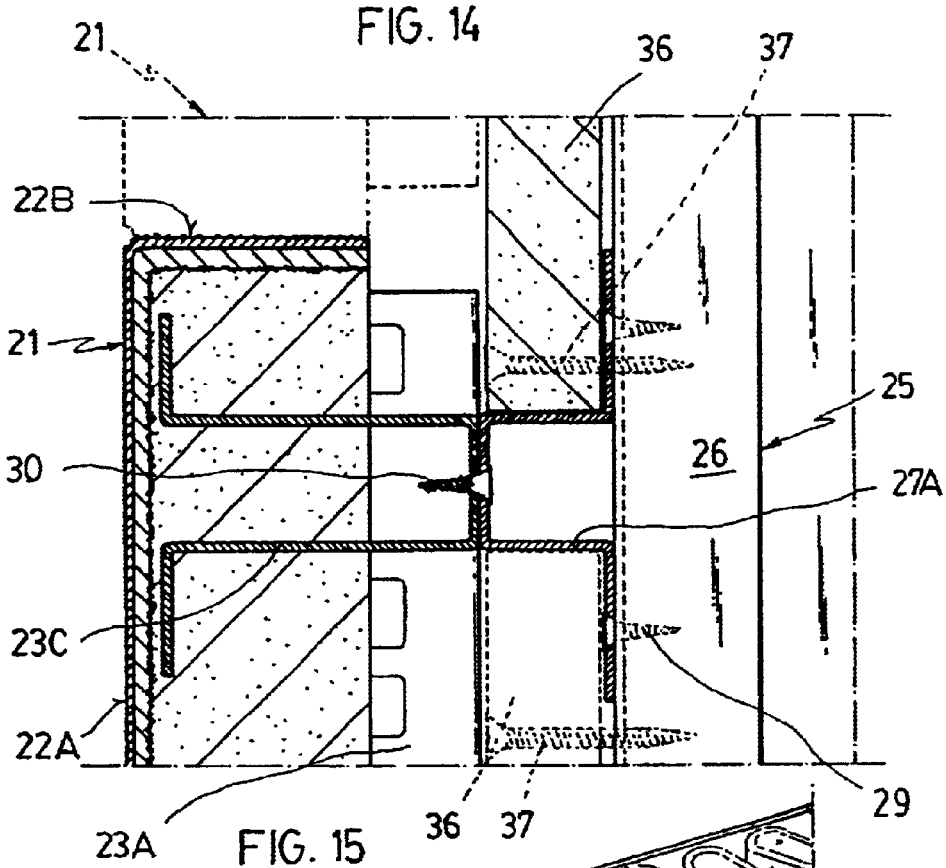
FIG. 14 is also a schematic vertical cross section view of a joining node of a building, where the facade panel and the internal panel are independently attached to the latticework support structure.

FIG. 14 shows the case of a connecting node between the facade panels 21 and the lattice structure 25. It is to be seen that a reinforcement section 23C of the reinforcement 23 of the facade panel 21 is attached directly to the cross member 27A of the lattice structure 25 by means of the screw 30, which is also self-tapping and self-boring, while the internal slab 36 is mounted directly on the cross member sections 27C and upright section 26 of the support structure. In this way, it is possible on the one hand to make independent and assure the direct assembly of the facade panels 21 to said lattice structure 25, which panels are not affected by settling movements of the building, earthquakes, vibrations, etc. which may affect the structure, since they are capable of absorbing the stresses produced by the deformation of the lattice structure 25 caused by such movements and, on the other hand, the arrangement of the internal slabs 36 fixed by screws 37 to the wings of the cross members 27A and to the uprights 26 themselves, or to both separately, means that said interior slabs act by compression, in their seat on the cross members 27A and uprights 26 and/or by tension, as struts, whereby the use of said herring-bone struts required in lattice work structures to prevent deformation of the parallelograms forming them, by converting such parallelograms in triangles, is obviated.

Figure 15:
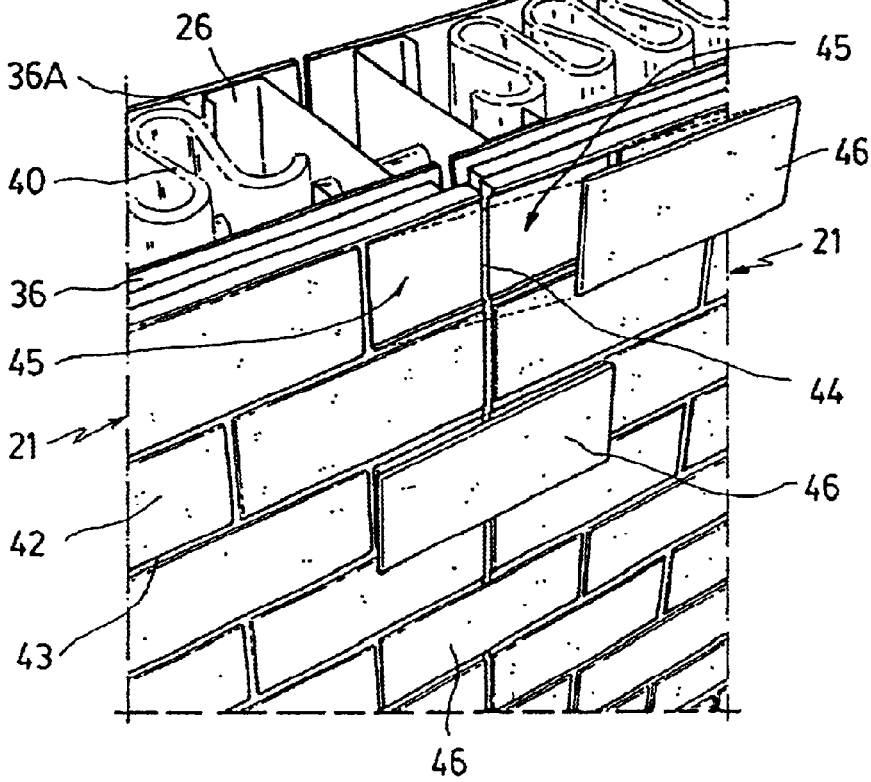
FIG. 15 is a perspective view of the visible faces of two facade panels where brickwork is imitated in relief and in which an arrangement according to the invention is adopted.

FIG. 15 shows two facade panels 21, placed edge-to-edge, forming a conventional wall structure. In this case, the visible faces of the panels imitate brickwork laid in break-joint style, formed by horizontal rectangular relief elements 42, which reproduce the visual effect of a visible longer side of a brick and grooves 43, arranged horizontally relative to the relief elements and vertically, defining the break-joint position and reproducing the conventional mortar joints between them.

FIG. 15 also shows the separation joint 44 between said two panels 21 and two depressed regions 45 which are aligned on both juxtaposed edges, each of which has the shape of half a visible brick side. These depressed regions 45 have a roughened surface and a shape, when taken together, equivalent to the longer visible face of the brick. A veneer block 46 reproducing the said longer visible side surface of the brick is firmly embedded in said depressed regions with mortar or other material.

Figure 16:
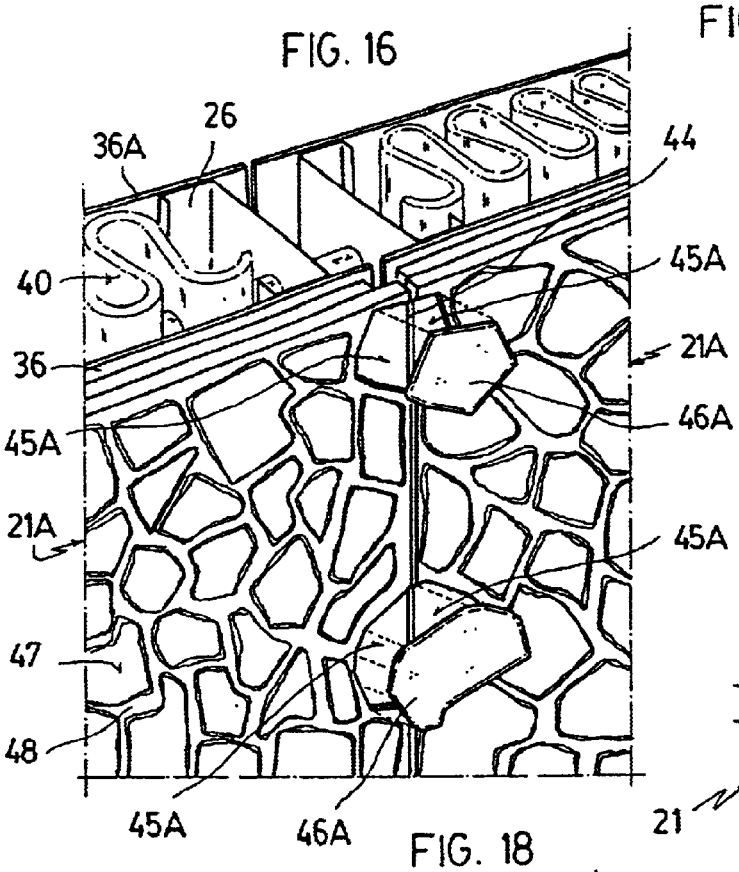
FIG. 16 is a similar view to FIG. 15 with two facade panels imitating natural stone masonry on the visible faces thereof.
Figure 17:
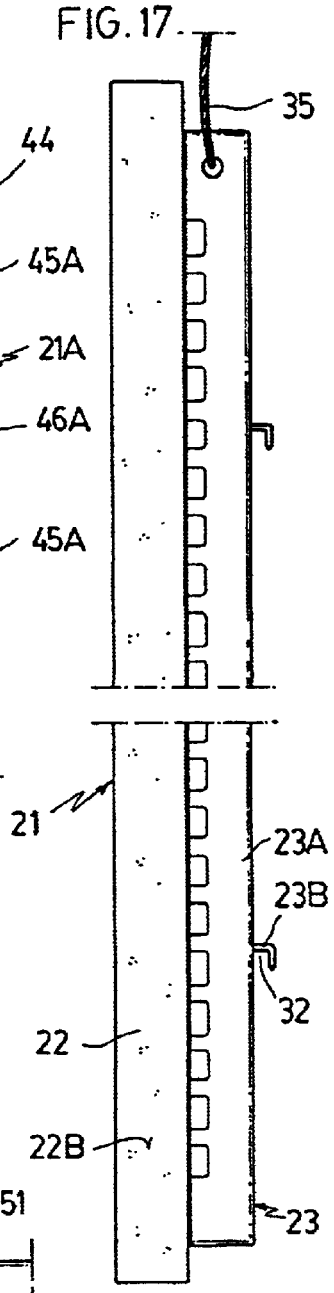
FIG. 17 is a side elevation view of the panel shown in FIG. 12.

Likewise, FIG. 16 illustrates two facade panels 21A in which the visible face imitates natural stone masonry 47 formed by a plurality of relief elements which reproduce the visual effect of stones 47 substantially inlaid and attached by perimetral joints 48.

Also outstanding in FIG. 16 is the separation joint 44 between said panels 21A and two depressed regions 45A which, together, have the shape of a stone. A veneer block 46A reproducing a natural stone 47 is firmly embedded therein with mortar or other material.

It is, therefore, obvious that with the system or arrangement of elements according to the invention, the object of the invention is achieved, assuring the attachment of the facade panels 21 and stabilizing the lattice support structure.

A facade panel 21, appropriate for manufacture in the plant according to the invention, is shown in particular in FIGS. 15*a*, 12, and 17 to 19, where it will be seen that it is constituted by a cement mortar sheet 22 in which there is embedded a metal reinforcement 23.

Figure 18:
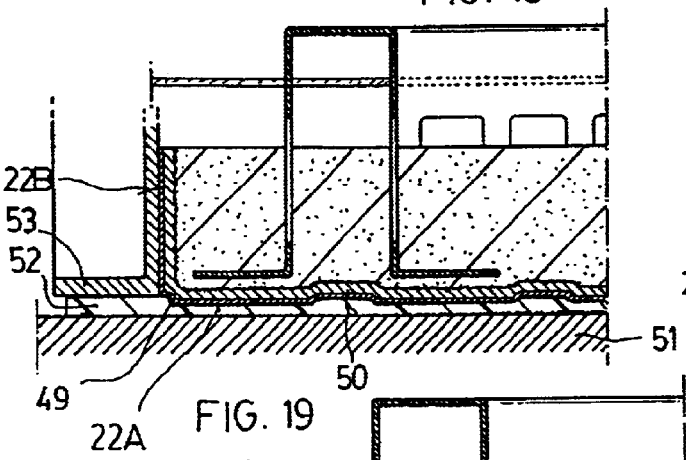
FIG. 18 is a cross section view, in the molding stage, of an edge portion of the panel of FIG. 12, where the panel has the visible face and the edges made from a different material than the rest of the panel body.
Figure 19:
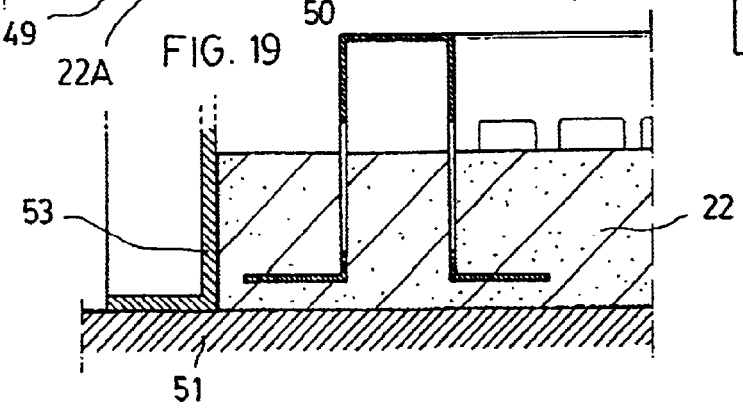
FIG. 19 is a view similar to FIG. 18, where the material constituting the visible face and the edges of the panel is the same as that of the resistant body.

The cement mortar slab 22, as shown in FIG. 18, may have the visible face 22A and the edges 22B thereof formed by a thin compound layer 49 of a resin (gel coat), or by a simple layer of a fine cement mortar paste, provided in both cases with a pattern constituted by relief elements and/or color associations which configure architectural forms and/or imitate brickwork, natural stone, masonry, etc. Said layer 49 is firmly anchored by way of a second layer 50 to the body of the slab made from cement mortar. FIG. 19 shows the case in which the visible face 22A of the facade panel 21 is constituted by the same cement mortar as forms the body of the slab and is provided with normally simple relief elements, such as bush-hammering, graining, etc, to prevent the visible face of the panel from appearing to be brightly polished.

FIG. 18 shows, further to the construction of the facade panel 21, the specific arrangement adopted for the molding thereof, which is formed by a mold carrier device 51, represented by a simple engraved metal sheet, an ornamentally patterned mold 52 of polyurethane, silicone or other materials and side members 53 which act as a frame and laterally hold said molds. In this case, the patterned mold 52 reproduces the negative image of the of the ornamentation it is desired to confer on the facade panel 21, such as brickwork, natural stone, masonry, wood, marble, etc.

Likewise, FIG. 19 shows the molding arrangement for the facade panel 21 when the latter is not provided with the thin compound resin or simple cement mortar paste layer 49 and the visible face 22A and the edges 22B are constituted by the cement mortar itself of the body of the slab 22 of the facade panel 21. To this end, the molding arrangement is constituted by the carrier device 51, provided with a simple surface engraving for matting the surface of the visible face 22A of the facade panel and by the side members 53. In this case, the steps obliging the use of the resins, the coarse grains and the polyurethane molds are omitted, whereby the panels are simpler, cheaper and quicker to manufacture. They are of special application in the construction of dignified social dwellings, dispensaries, schools and other constructions in which the external decoration is of secondary importance and only the comfort and security of the building matters.

Figure 20:
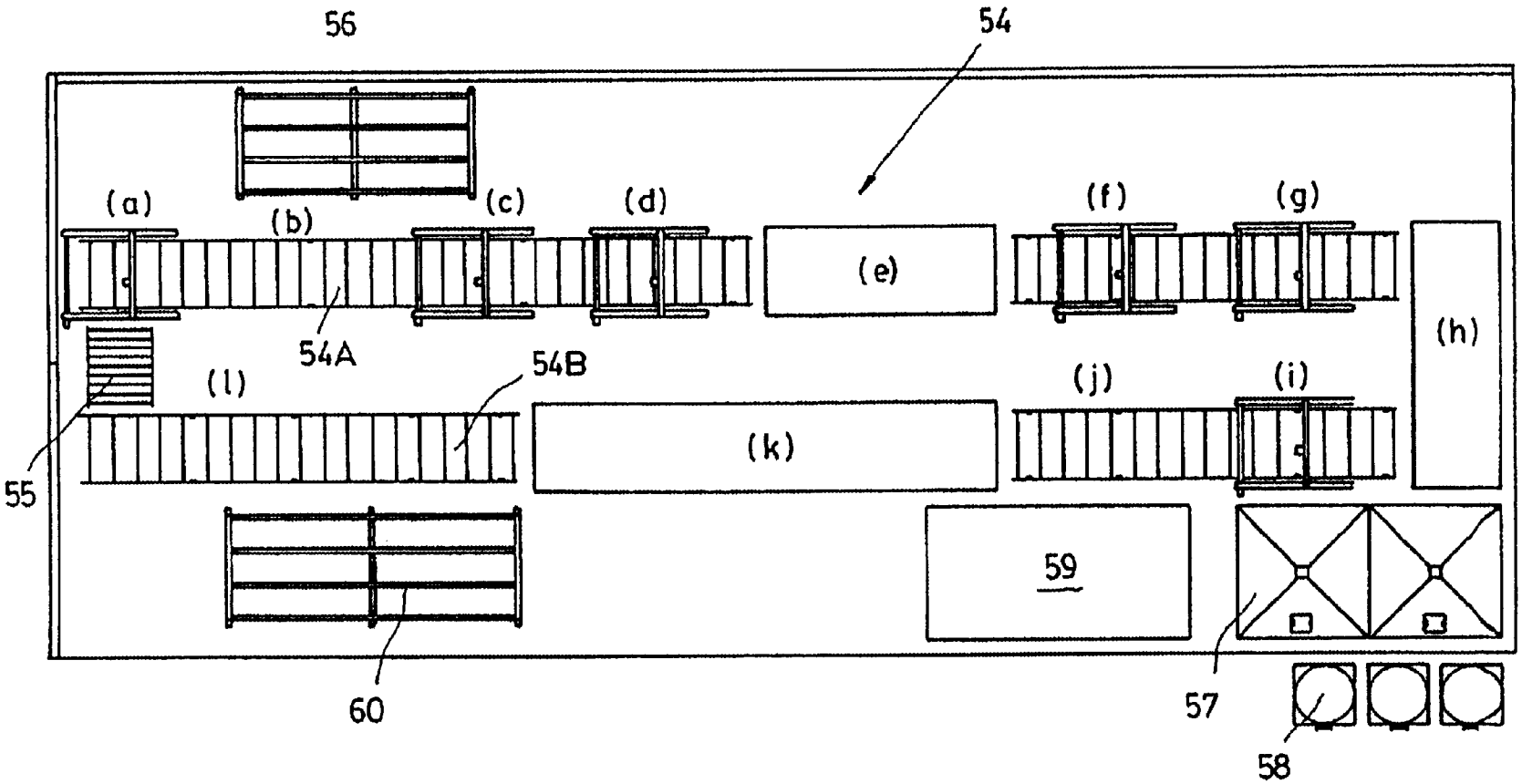
FIG. 20 is a schematic plan view of a plant for the manufacture of the panels according to the invention.

A plant appropriate for the manufacture of the disclosed variations of facade panels 21 is illustrated in FIG. 20 and corresponds to an actual premises of about one thousand square meters in area.

The installation of the Figure is provided with a track 54 for the movement of the not shown mold carrier devices, alone or with molds. The track, in this case, is constituted by two equal parallel portions 54A and 54B which are connected at the ends thereof by a transfer table 55 and a work station h.

The first track portion 54A comprises, successively, the following work stations appropriate for the manufacture of a facade panel 21 having an ornamental visible face, such as the one shown in FIG. 20:

(a) means for cleaning the molds, appropriate for removing any mortar and mold stripper remains deposited thereon, (b) means for changing the molds, to be used when the panel to be manufactured has different features from those of the panel which has been stripped from the mold, which means are complemented by shelving for use as a mold store, (c) means for applying a mold stripping product over the entire molding surface, (d) means for spraying a thin layer of a first resin (gel-coat) which waterproofs and enhances the pattern of the visible face of the panel, (e) a tunnel with shelving for storing the molds in the carriers thereof, in stand-by for the curing of the resin sprayed in the molds and/or for the following operation on the mold, (f) means for spraying a thin layer of a second anchor resin on the first resin layer, (g) means for spraying a layer of coarse grained sand, shot, etc. on the second resin layer, so as partly to incrust said coarse grains in the resin and for removing the grains not adhering thereto.

From the first track portion 54A the operation transfers to the second track portion 54B by means of the tunnel h with shelving for storage of the carriers bearing the molds charged with both resins and the coarse grains incrusted in the second resin, in stand-by for the curing of the second resin and/or the following operation.

The remaining work stations are located on the second track portion 54B:

(i) means for pouring cement mortar, which is prepared from the cement, aggregate, water and additives drawn from silos adjacent the station, (j) means for placing the reinforcement in the cement mortar and, optionally, a suspension cable for the panel anchored in said reinforcement, (k) a tunnel kiln with shelving for the setting of the cement mortar, and (l) mold stripping means and shelving for stacking the finished panels.

On the other hand, for the construction of a facade panel 21 as detailed in FIG. 19, the sequence of operative stations would be as follows:

means for cleaning (a) the molding surfaces, appropriate for removing any mortar and mold stripper remains, means for applying (c) a mold stripping product over the entire molding surface, a tunnel (h) with shelving for storing the molds in the carrier devices therefor, in stand-by for the following operation, means for pouring (i) cement mortar, which is prepared from the cement, aggregate, water and additives drawn from silos adjacent the station, means for placing (j) the reinforcement in the cement mortar and, optionally, a suspension cable anchored in said reinforcement, a tunnel kiln (k) for the setting of the cement mortar, and mold stripping means (l) and shelving for stacking the finished panels.

Obviously, in the manufacture of the facade panels 21 of the type shown in FIG. 19, specific stations remain inoperative in the plant and will be operative when manufacturing facade panels 21 like those shown in FIG. 18.

When the manufacture of facade panels 21 according to FIG. 18 were not contemplated in the plant, this would be reduced to the means and elements listed above and as defined in the second claim.

According to a preferred embodiment of the invention, the track 54 is arranged as a closed circuit on a horizontal plane, specially constituted by two straight, substantially parallel portions 54A and 54B connected together at the ends thereof by a work station h and/or transport means 55. Nevertheless, the two straight portions 54A and 54B could be disposed on parallel superimposed planes.

The track 54 is constituted by a rotating roller path, some of them being motorized.

The plant is completed by shelving 56 for the storage of polyurethane molds, with silos 57 for the cement and aggregate, with tanks 58 for the mortar additives, with a workshop 59 for the reinforcement 23 and with shelving 60 for stacking the finished facade panels 21.

What is claimed is:

1. A building facade panel adapted to operably engage and close a latticework support structure having uprights connected by horizontal crossmembers, said panel comprising:

a slab comprised of an air-setting resistant material and having opposed faces, one face comprising a visible face defining a molded pattern; and reinforcement means having a portion embedded within the slab and extending outwardly thereof so as to form an outwardly accessible portion, the portion embedded within the slab being configured to extend through the slab, away from the visible face, and then outwardly or the other face of the slab as the outwardly accessible portion, the outwardly accessible portion defining a spine configured to oppose and operably engage a corresponding spine defined by the latticework support structure when the panel is attached thereto the spines being secured together by mechanical fixation means, the reinforcement means being adapted to reinforce the slab and to allow the slab to be attached to the latticework support structure such that the panel covers the latticework support structure.

2. A panel according to claim 1 wherein the air-setting resistant material is selected from the group consisting of cement concrete, cement mortar, resin mortar, mixed mortar, normal synthetic resin, lightened synthetic resin, and combinations thereof.

3. A panel according to claim 1 wherein the reinforcement means further comprises a channel having a cross-section including an open end and a closed end, the open end being defined by opposing flanges and comprising the portion embedded in the slab.

4. A panel according to claim 3 wherein the portion of the reinforcement means embedded in the slab further defines a plurality of upertures configured to allow the air-setting resistant material to pass therethrough so as to facilitate securement of the reinforcement means within the slab.

5. A panel according to claim 1 wherein the reinforcement means further comprises a plurality metal sections disposed with respect to the slab so as to form a frame arrangement therefor.

6. A panel according to claim 5 further comprising a plurality of corrugated rods extending between the metal sections of the frame arrangement for facilitating securement of the reinforcement means within the slab.

7. A panel according to claim 1 further comprising a resilient, resistant filiform member operably engaged with the reinforcement means and configured to secure the panel to the latticework support structure.

8. A panel according to claim 1 wherein the outwardly accessible portion further comprises a channel having a U-shaped cross-section with an open end, the channel extending from the spine of the outwardly accessible portion such that the open end is downwardly oriented and configured to operably engage a flange extending upwardly from the spine of the latticework support structure.

9. A panel according to claim 1 wherein the outwardly accessible portion further comprises a flange extending downwardly from the spine of the outwardly accessible portion, the flange being configured to operably engage a channel having a U-shaped cross-section with an open end, the channel extending from the spine of the latticework support structure such that the open end is upwardly oriented.

10. A panel according to claim 1 wherein the reinforcement means extends outwardly from the slab so as to form a side thereof.

11. A building facade panel system adapted to operably engage and close a latticework support structure having uprights connected by horizontal crossmembers, said system comprising:

a plurality of panels, each panel defining an edge and comprising:

a slab comprised of an air-setting resistant material and having opposed faces;

a surface layer operably engaged with the slab and substantially covering one face of the slab, the surface layer defining a pattern having a plurality of relief elements, the pattern including a depression disposed about the edge; and reinforcement means having a portion embedded within the slab and extending outwardly thereof so as to form an outwardly accessible portion, the outwardly accessible portion being configured to extend away from the one face and outwardly of the other face of the slab, the reinforcement means being adapted to reinforce the slab and to allow the slab to be attached to the latticework support structure such that the panel covers the latticework support structure; and an insert configured as a relief element, the insert being capable of being inserted into a receptacle defined by corresponding depressions of juxtaposed panels and thereby providing continuation of the pattern on the surface layer between panels and covering a joint between the juxtaposed panels defined by the respective edges thereof.

12. A panel according to claim 1 wherein the spine defined by the outwardly accessible portion is configured to oppose and operably engage the corresponding spine defined by the latticework support structure such that the outwardly accessible portion spine hangs from the latticework support structure spine when the panel is attached to the latticework support structure.

13. A system according to claim 11 wherein the reinforcement means is configured to be attached to the latticework support structure such that the slab hangs therefrom.

* * * * *

UNITED STATES PATENT AND TRADEMARK OFFICE

CERTIFICATE OF CORRECTION

PATENT NO. : 6,857,241 B1
DATED : February 22, 2005
INVENTOR(S) : Pellicer

It is certified that error appears in the above-identified patent and that said Letters Patent is hereby corrected as shown below:

Column 13,
Line 34, “or” should read -- of --;
Line 57, “upertures” should read -- apertures --;
Line 61, after the word “plurality” insert -- of --.

Signed and Sealed this

Twenty-fourth Day of May, 2005

JON W. DUDAS
*Director of the United States Patent and Trademark Office*